US007857689B2

(12) United States Patent
Perry

(10) Patent No.: US 7,857,689 B2
(45) Date of Patent: Dec. 28, 2010

(54) AIR HANDLING SYSTEM WITH SELF BALANCING AIR ENTRANCE DOOR

(76) Inventor: Jonathan C. Perry, 2525 Beaufort Ave., Virginia Beach, VA (US) 23455

( * ) Notice: Subject to any disclaimer, the term of this patent is extended or adjusted under 35 U.S.C. 154(b) by 0 days.

(21) Appl. No.: 11/689,235

(22) Filed: Mar. 21, 2007

(65) Prior Publication Data

US 2008/0233860 A1 Sep. 25, 2008

(51) Int. Cl.
*F24F 9/00* (2006.01)

(52) U.S. Cl. ..... 454/188; 454/187

(58) Field of Classification Search ..... 454/187, 454/188

See application file for complete search history.

(56) References Cited

U.S. PATENT DOCUMENTS

| | | | | |
|---|---|---|---|---|
| 2,763,195 | A | | 9/1956 | Caldwell |
| 3,115,818 | A | | 12/1963 | Smith |
| 3,221,632 | A | | 12/1965 | Copp |
| 3,308,740 | A | | 3/1967 | Henson et al. |
| 3,664,253 | A | | 5/1972 | Asker et al. |
| 3,687,053 | A | | 8/1972 | Henson et al. |
| 3,715,968 | A | | 2/1973 | Henson |
| 4,896,829 | A | * | 1/1990 | Kawamura ..... 237/2 A |
| 4,967,645 | A | * | 11/1990 | Mattson ..... 454/296 |
| 5,431,599 | A | * | 7/1995 | Genco ..... 454/187 |
| 6,106,387 | A | * | 8/2000 | Smith ..... 454/190 |
| 6,790,136 | B2 | * | 9/2004 | Sharp et al. ..... 454/229 |
| 2004/0058637 | A1 | * | 3/2004 | Laiti ..... 454/229 |

* cited by examiner

*Primary Examiner*—Steven B McAllister
*Assistant Examiner*—Samantha A Miller
(74) *Attorney, Agent, or Firm*—Ishman Law Firm P.C.

(57) ABSTRACT

A self balancing air handling system for conditioning an interior space includes an air handling unit having an outlet for supplying conditioned air to the space, an entrance providing an access from an exterior space to the interior space, an air plenum surrounding said space, and an inlet for returning air from said plenum to said air handling unit wherein said air handling unit supplies said conditioned air under conditions providing a positive pressure differential at said entrance between the interior space and the exterior space thereby limiting infiltration air into the interior space.

10 Claims, 3 Drawing Sheets

AIR HANDLING SYSTEM WITH SELF BALANCING AIR ENTRANCE DOOR

FIELD OF THE INVENTION

The present invention relates to recirculating forced air systems and, in particular, to a room entrance air return system that utilizes air return flow to balance air pressures and control air infiltration.

BACKGROUND OF THE INVENTION

Air Handling Units (AHUs) are widely used in with heating, ventilating, air conditioning, and refrigerating (HVACR) systems to control temperature and humidity in commercial spaces. Outdoor air usually accounts for the largest heat transfer load. The term "outdoor air" can refer to air from outside the room, or air from outside the building. Outdoor air generally imparts loads on these systems by entering through door openings and dedicated AHU outdoor air intake openings. Minimization of air infiltration without a sacrifice in air quality is a common goal of HVACR system design.

In the interest of reducing air infiltration issues, air entrances have been established that use high velocity air streams impinged on door openings at right angles to the flow direction of people or products through the door opening. These systems reduce air infiltration at the cost of added fan power and limitations on operational effectiveness due to the maximum velocity. Maximum velocity is dictated by what is comfortable to the customer or users of the interior space. Such air entrance doors have been used in buildings such as supermarkets for over 40 years. According to Boon Edam there are over 3,000 entrances considered air entrance doors around the world. Claimed benefits include reduced insect and rodent infiltration (claims as high as 50%); comfortable front end areas; an open feel to the building occupants; less dirt in the buildings; energy savings; and no automatic door law suits or maintenance for automatic doors. Detracting from these benefits are high capital costs; negligible energy savings and possibly an increase in energy consumption; annoying air blowing on customers' hair; cold drafts in the winter, warm drafts in the summer as customers walk through the entrance; maintenance problems of keeping a pit clean and an additional HVAC system to repair; and a large floor grille that some people are uncomfortable to walk on, approximately 5 feet across.

SUMMARY OF THE INVENTION

The present invention provides an air handling system for enclosed spaces that maintains a neutral static pressure on the building while still allowing a large opening in the building to be used frequently such as an entrance into a supermarket. In one aspect, the invention provides a self balancing air handling system for conditioning an interior space including an air handling unit having an outlet for supplying conditioned air to the space, an entrance providing an access from an exterior space to the interior space, an air plenum surrounding the entrance, and an inlet for returning air from the plenum to the air handling unit wherein the air handling unit supplies air under conditions providing a positive pressure differential at the entrance thereby limiting infiltration air into the interior space from the exterior space.

The system incorporates a special air plenum connected to the return air of the AHU at the entrances to the conditioned space. The supply air of the system is distributed to the space such that the air flow pattern moves toward the building entrance, contrary to current designs. This creates a mass of moving air that establishes a pressure differential at the entrance interface that is capable of offsetting infiltration air seeking to enter the space from the exterior. The infiltration air now collides with the supply air from the building in a positive pressure interface forcing the outdoor air and all of its contaminants into the air handling return air intake. The AHU air return flow achieves balanced air pressures and controls air infiltration. The AHU return air is gathered at the door opening in a direction that is in 180 degree opposition to air infiltration from outside of the treated room or treated building. Due to the larger velocity pressure of the return air stream, the infiltration air stream cannot move into the room. Therefore, as the opposed air streams meet, the smaller air stream, the infiltration air stream, is entrained into the larger air stream, the return air stream. This mixture of air streams can be described as a mixed return air stream. The mixed return air stream is gathered into an air entrance plenum system that eventually forms a singular mixed return duct to deliver the mixed return air stream to an AHU for treatment. Treatment in the AHU may include heating, humidification, ventilation, cooling, sterilization, and dehumidification. As is common practice, the AHU delivers the treated air to a supply duct system. The supply duct system supplies treated air to the room or building. This supply air flows through the room or building and returns again to the air return and entrance door.

Accordingly, it is an object of the invention to provide an air handling system that is integrated with the entrance of the building so that the majority of the outdoor intake air is brought through the entrances of the building in such away that a neutral building pressurization is achieved passively.

Another object is to provide an air handling system that is able to compensate for large winds entering a building thereby reducing drafts.

A further object is to provide a system that utilizes the mechanical energy of the return air velocity pressure to offset inward pressures of the outdoor ambient air that infiltrate a building.

Yet another object is to provide a system that does not have the additional cost of separate installed Air Entrance components like fans and heaters.

Still another object is an entrance door system that is very simple to install and balance in regards to makeup air and outdoor air infiltration.

DESCRIPTION OF THE DRAWINGS

The above and other features and advantages of the present invention will become apparent upon reading the following description taken in conjunction with the accompanying drawings in which.

DESCRIPTION OF THE PREFERRED EMBODIMENTS

Figure 1:
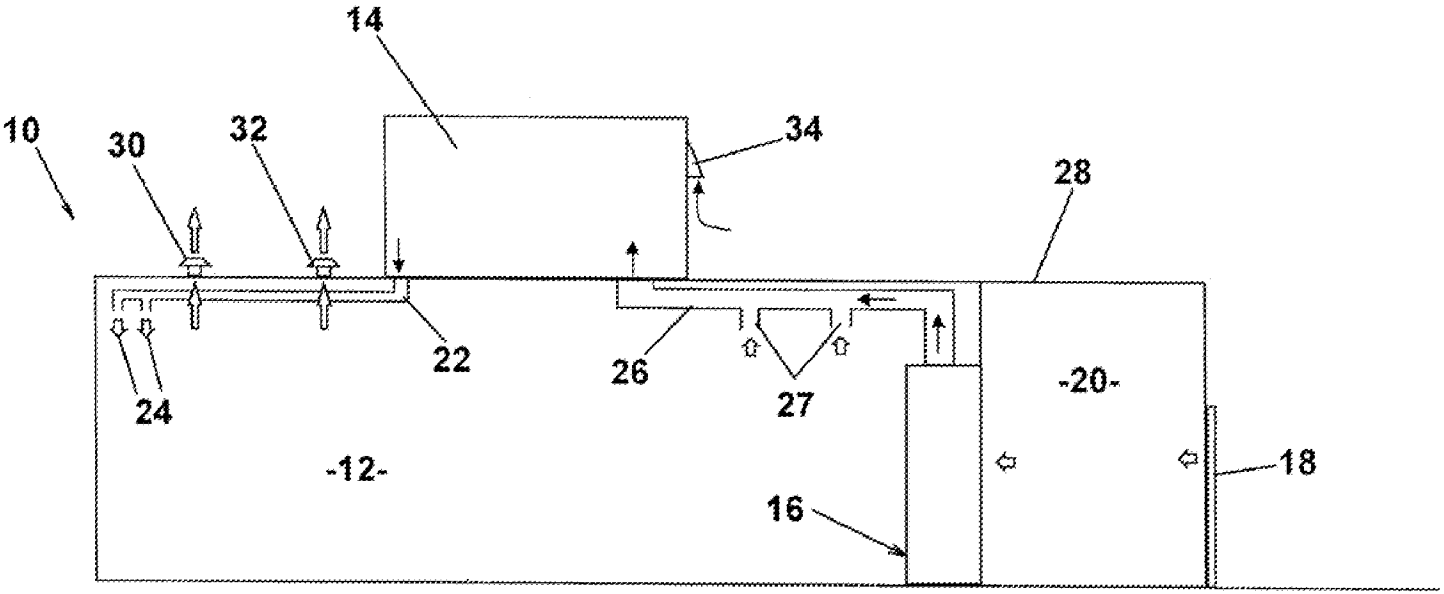
FIG. 1 is a schematic side elevational view of a building with an air return self balance entrance door for a HVACR system according to an embodiment of the invention.

Referring to FIG. 1, there is shown a structure 10 having an interior space or room 12 provided with a controlled environment treated by conditioned air from an air handling unit (AHU) in conjunction with a Heating, Ventilating, Air Conditioning and Refrigeration system. The AHU is provided with return air, in whole or in part, from an air balanced return air entrance door 16. Entrance to the space 12 at the door system 16 is provided through an exterior door 18 and vestibule 20. The AHU 14 utilizes a supply duct 22 with diffusers 24 to supply treated air to the interior space 12 and return air to the AHU 14 with a return duct 26 provided optionally with return inlets 27. The diffusers 24 may be directed toward the air entrance 16. Conventionally, the AHU 14 is located on the roof 28 of the structure. The AHU, however, could be installed outdoors on a ground slab, indoors on a mezzanine, indoors hung from the ceiling, indoors on a frame, or indoors on the floor. One or more exhaust fans 30, 32 may be provided for operations within the space 12, such as vent fans for food preparation activities in related commercial operations, such as supermarkets, deli sections, and the like. Compensating exhaust fans, combining indoor and outdoor air may be used. Also, the system may be operated within totally enclosed spaces, such a refrigerated areas within a larger floor complex.

Where building codes require forced ventilation of indoor spaces when air contaminate levels rise (such as $CO_2$), an optional outdoor air intake 34 is added to AHU 14. In this case, the ventilation requirement may be satisfied by turning on the exhaust fans 30, 32, and opening outdoor air intake 34 through manual operation or automatic controls. Thus, the outdoor air intake 34 and the exterior door 18 would both bring in outdoor air to mix in the return air system as described below. The exterior door 18 is the physical barrier to the outdoor environment. The return air inlets 27 may not be required if the return air requirements for the entrance door 16 are satisfied in a dynamically balanced condition, responding as necessary by altering the content of infiltration air from whatever the source. The exterior door 18 may be open full time, or it may open and close intermittently or dependent on environmental conditions. Each space may include one or more additional entrance door systems. One or more air handling units may service the space, however, the system overall will operate each entrance door as described below.

Figure 2:
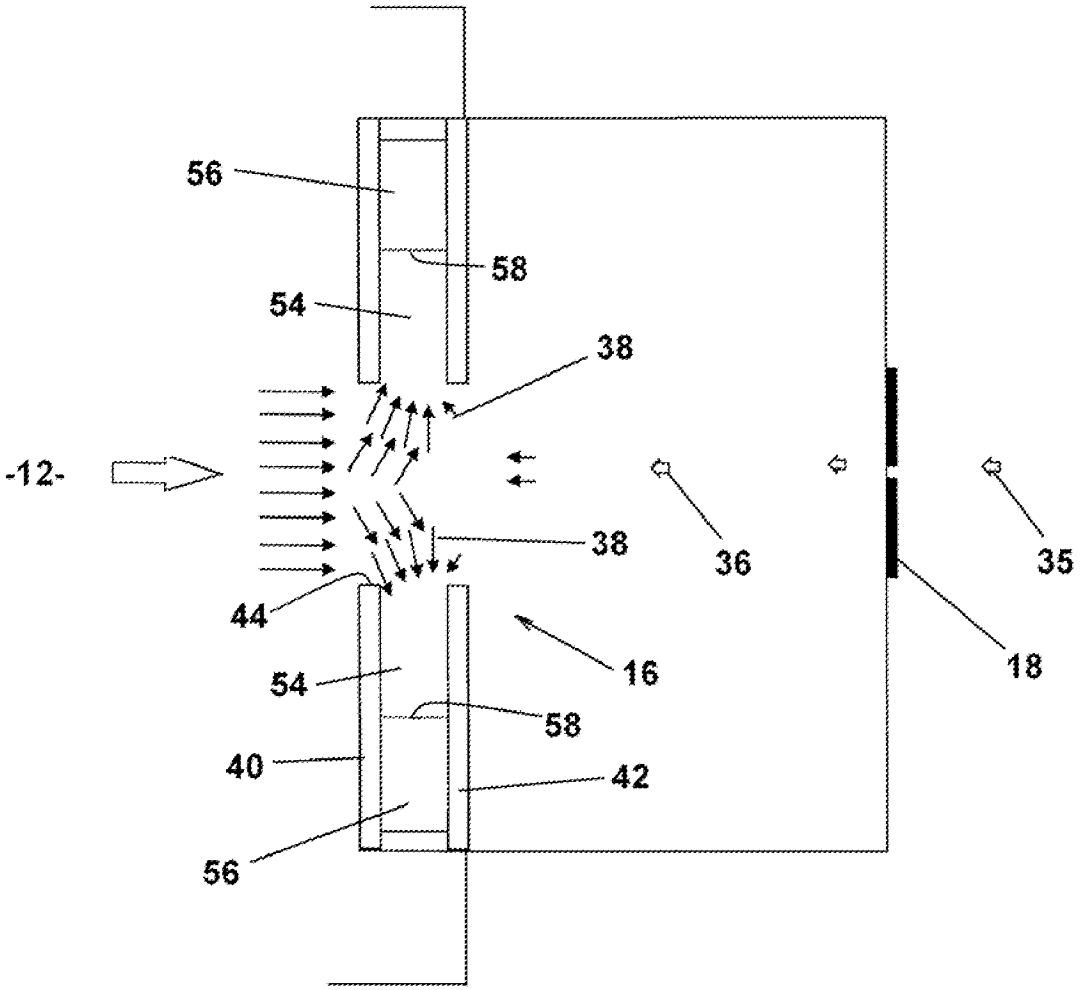
FIG. 2 is a schematic plan view the air return and entrance door.

Referring additionally to FIG. 2, outdoor air 35 enters into door 18 and travels through the vestibule 20 as infiltration air 36, indicated by the arrows. This infiltration air 36 is entrained into the return air 38 entering the air entrance 16. This creates a mixed air stream that travels through return duct 26 to enter AHU 14. The average hourly exhaust air flow of fans 32, 34 will be nearly the same as the average hourly infiltration air flow through door 18 and the intake 34, if the space 12 and vestibule 20 are nearly air tight. For wind gusts and excessive outside air velocity, the system will also quickly balance resulting in only momentary exterior incursions.

Figure 3:
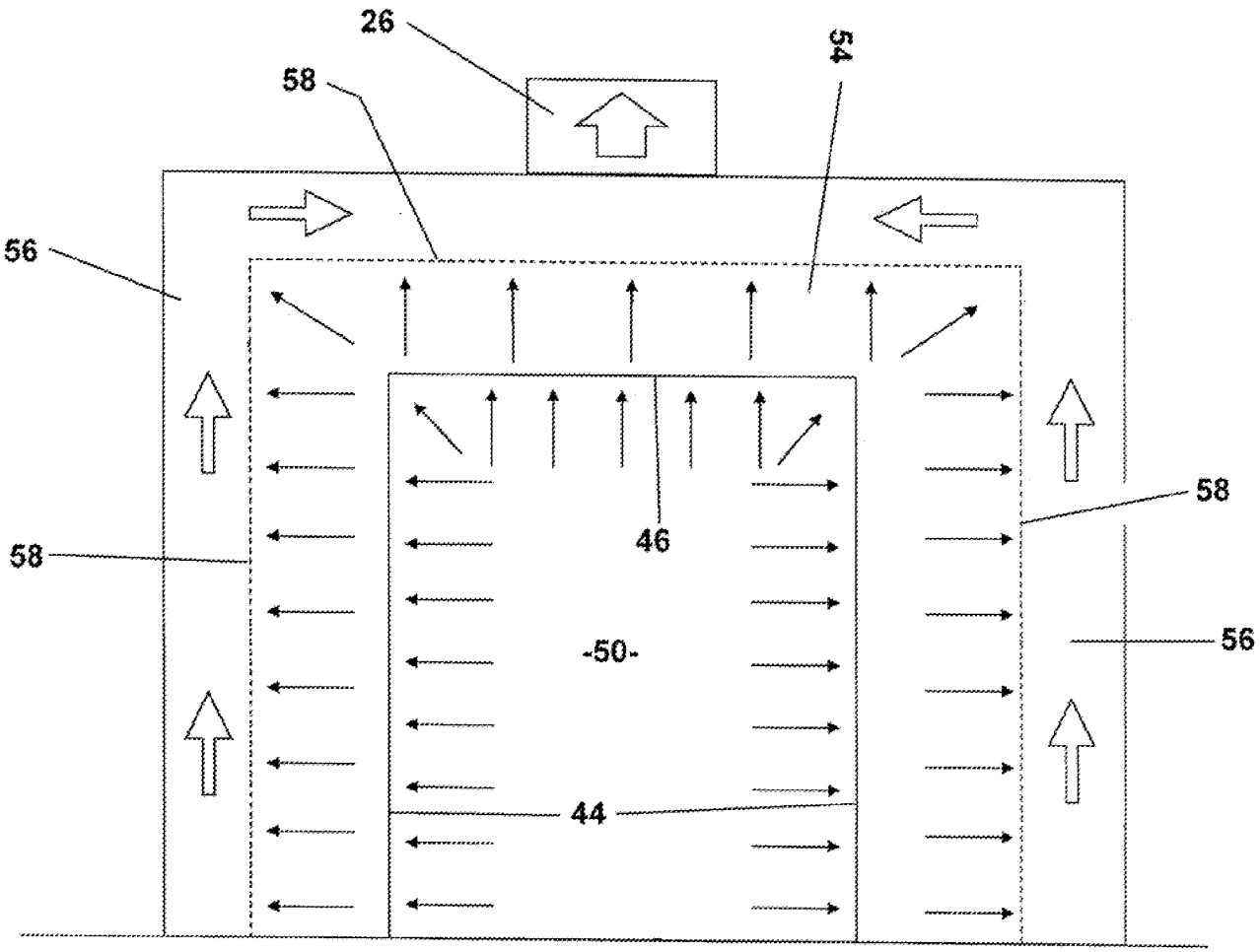
FIG. 3 is a schematic front view of an air return and entrance door.

Referring to FIGS. 2 and 3, the entrance door 16 comprises spaced front and rear wall sections 40, 42 having vertical jambs 44 and horizontal headers 46 defining a front doorway or opening 50 between the vestibule 20 and the room 12. The interior surfaces of the sections 40, 42 define a peripheral slot 54 having an inverted U-shaped air plenum 56 at the base circumscribed by an intake grill 58. The upper end of the base plenum 56 is fluidly coupled with the return duct 26. Multiple connecting ducts may be provided for connecting sections of the plenum with the main return duct 26. Accordingly, the air stream entering the base plenum 56, and the optional air intake 34, constitute the return air supply for the AHU 14, along with the optional return air intakes 27.

Referring to FIGS. 2 and 3, the infiltration air from the exterior door 18 is entrained into the return air as the air streams meet and enter air entrance 16. The total air pressure (TP) at a given point in air entrance 16 may be defined by the sum of the static air pressure (SP) and the velocity air pressure (VP). TP=SP+VP. Since two air streams meet at this point, $TP_1=TP_2$, where $TP_1$ is the indoor total pressure and $TP_2$ is the vestibule total pressure. By operating the system to provide a velocity pressure ($VP_1$) of the indoor room is higher than that of the vestibule ($VP_2$), the infiltration air will not tend to travel into indoor room 12. Instead the positive pressure differential will cause the potential infiltration air to entrained into air entrance 16.

It is commonly known that in commercial spaces the static pressure of the indoor room ($SP_1$) is naturally lower than that of the vestibule ($SP_2$) and necessarily lower than the static pressure outdoors. This difference varies in accordance with prevailing exterior conditions and often causes significant infiltration in conventional systems. With the air entrance 16, this difference in static pressure is overcome by an opposite difference in velocity pressures, causing all of the infiltration air to be carried to the AHU for treatment rather than passing to indoor room 12. This will occur through the provision of an air handling unit that provides sufficient mass flow to provide the positive pressure differential notwithstanding the variations in air demands.

Thus, for facilities have a large interior space, the air flow rate for conditioning the air may be in excess of that required for balanced air entrance door. Accordingly, interior space return inlets may be used as required. Where ventilation makeup air requirements, ongoing or intermittent, are a consideration, the air handling unit provides a sufficient net flow to establish the pressure differential.

Field testing has verified that system can create velocity pressures at the entrance door sufficient to overcome outdoor air infiltration with hourly average return air velocities ranging from 150 standard feet per minute (sfpm) to 500 sfpm. Lower velocities may allow the interface to be temporarily penetrated by wind gusts. Higher velocities can lead to excessive turbulence and drafts. These supply conditions can function properly with infiltration air velocities at air entrance 16 ranging up to 150 sfpm. Within these design velocities, the entrance door will self balance at each point where the air streams collide, or mix, such that $TP_1=TP_2$ and therefore $SP_1+VP_2=SP_2+VP_2$. This self balancing effect means that the air infiltration will naturally increase and decrease with changes in indoor exhaust, changes in outdoor wind speed, and changes in door openings. During this self balancing the infiltration air is captured at numbers approaching rates of 95 to 100% by air entrance 6.

The balancing can also be enhanced by considerations at the plenum air intake. For instance, it is well known that colder air at the lower door levels can constitute a source of outward air flow from the room. Accordingly, the intake design can provide for greater air velocity at the lower portions of the opening and lesser air velocity and flow at the upper portions. If the point of collision of air entrance 16 has velocities on the low end of the spectrum, optional air flow baffles can be utilized to improve air distribution and insure that the air flow from the lower half of air entrance 16 is sufficient to capture infiltration air from the vestibule. Also, rather than a continuous grid, air flow adjustment means including vanes, baffles and the like can be used at discrete locations about the entrance surround for achieving the desired distribution and balance of air flow.

The foregoing is also illustrated by the following example.

Example 1

A supermarket having an interior space of about 50,000 sf. had an air handling unit with a capacity of 30,000 cfm. An entrance opening of 8 ft by 8 ft was surrounded by an air plenum 2 ft in width and 2 ft in depth. A honeycombed grill was used for the plenum intake. Average supply air velocity at the entrance was 270 fpm. Average velocity entering vestibule was 40 fpm. Average velocity at the entrance door was 32 fpm. Without exhaust fans operating, average intake velocities through the grill were measured by anemometer at about 323 fpm. Outside temperature was at 15° F. Wind gusts were periodic. During wind gusts, it was noted with smoke tests that the interface billowed inward, but remained intact, and after a short period a planar interface with minor turbulence was reestablished. Temperatures adjacent the interface remain at interior temperature. No noticeable drafts were experienced by patrons entering the store. When exhaust fans were operated, the interface again inwardly billowed, but was quickly reestablished. Short term comparisons indicated an energy saving over comparable historical periods thereby demonstrating that the air entrance can provide the open door balanced condition notwithstanding extreme ambient conditions of wind and temperature.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claim.

What is claimed:

1. A self balancing air handling system for conditioning an interior space comprising: an air handling unit having an outlet supplying conditioned air for the interior space; an entrance providing an access from an exterior space to the interior space wherein said outlet for said conditioned air is located remote from said entrance; a return air plenum on at least both sides of said access for returning air to an inlet of said air handling unit wherein said air handling unit supplies said conditioned air under conditions providing a positive velocity pressure differential at said entrance between the interior space and the exterior space against exterior infiltration air, said conditioned air having an air velocity in a plane transverse to said entrance of about 150 standard feet per minute whereby the infiltration air is entrained with said conditioned air at said access opening and directed by said velocity pressure to said plenum for return to said air handling unit.

2. The air handling system as recited in claim 1 wherein said air plenum is located between spaced wall sections having aligned openings providing said entrance and said air plenum is located at the sides and top of said entrance.

3. The air handling system as recited in claim 2 wherein said wall sections are parallel and define a recessed peripheral slot about said openings and said air plenum is located at the base of said slot.

4. The air handling system as recited in claim 3 including air intake means in said slot upstream of said air plenum for controlling air velocities about said air plenum.

5. An air handling system as recited in claim 1 including exhaust means for removing air from said interior space wherein said air handling unit supplies sufficient conditioned air during operation of said exhaust means to provide said positive velocity pressure differential at said entrance between the interior space and the exterior space.

6. The air handling system as recited in claim 5 including makeup air means supplying exterior air to said inlet of said air handling means and said air handling unit supplies sufficient conditioned air during operation of said makeup means to establish said positive pressure differential at said entrance between the interior space and the exterior space.

7. The air handling system as recited in claim 6 wherein said exterior space is a vestibule having an opening to the exterior allowing exterior air to enter said vestibule and supply infiltration air for replenishing air removed by said exhaust means while maintaining said positive velocity pressure differential.

8. The air handling system as recited in claim 1 wherein the air velocity toward said entrance from the exterior space is about 20 to 150 standard feet per minute.

9. The air handling system as recited in claim 1 wherein said air velocity is less than 500 standard feet per minute.

10. An air handling system comprising: an enclosed space having an access opening in a vertical plane provided by a solid base, opposed sides and a top; a return air plenum at both of said sides and top of said opening; an air handling unit having an outlet in said space for supplying conditioned air thereto remote from said access opening and an inlet fluidly connected with said return plenum; said conditioned air being supplied under flow conditions establishing a positive velocity pressure differential at said access having an air velocity transverse to said plane at said opening of 150 to 500 standard feet per minute against infiltration air from exterior of said space whereby the infiltration air is entrained with said conditioned air at said access opening and directed by said velocity pressure to said return plenum for return to said air handling unit.

* * * * *